US007455958B2

(12) United States Patent
Dean et al.

(10) Patent No.: US 7,455,958 B2
(45) Date of Patent: Nov. 25, 2008

(54) METHOD FOR ATTACHING SPACERS IN AN EMISSION DISPLAY

(75) Inventors: Kenneth A. Dean, Phoenix, AZ (US); Hao Li, Chandler, AZ (US)

(73) Assignee: Motorola, Inc., Schaumburg, IL (US)

( * ) Notice: Subject to any disclaimer, the term of this patent is extended or adjusted under 35 U.S.C. 154(b) by 498 days.

(21) Appl. No.: 11/240,171

(22) Filed: Sep. 29, 2005

(65) Prior Publication Data

US 2007/0069627 A1 Mar. 29, 2007

(51) Int. Cl.
*H01J 9/20* (2006.01)

(52) U.S. Cl. ..... 430/321; 445/24

(58) Field of Classification Search ..... None
See application file for complete search history.

(56) References Cited

U.S. PATENT DOCUMENTS 4,024,613 A * 5/1977 Martel et al. ..... 445/24
5,232,549 A 8/1993 Cathey et al.
5,463,269 A 10/1995 Zimmerman
5,717,287 A 2/1998 Amrine et al.
5,811,927 A 9/1998 Anderson et al.
6,042,445 A * 3/2000 Amrine et al. ..... 445/24
2004/0029482 A1 * 2/2004 Yang et al. ..... 455/24
2004/0058613 A1 * 3/2004 Hofmann et al. ..... 445/24
2004/0124426 A1 * 7/2004 Hasegawa et al. ..... 257/82

FOREIGN PATENT DOCUMENTS

JP 9-092184 A * 4/1997

OTHER PUBLICATIONS

International Search Report PCT/US06/25903 dated Jul. 7, 2008.

* cited by examiner

*Primary Examiner*—John A. McPherson

(57) ABSTRACT

A method is provided for bonding spacers (22) to an anode (12) and/or cathode (24) of a flat panel display. The method comprises forming a black matrix layer (26) between a ductile metal layer (28) and a first display plate (12), the black matrix layer (26) and the ductile metal layer (28) defining a plurality of regions (20) surrounding a plurality of pixels (16). A cathodoluminescent material (18) is formed within each of the pixels (16) and an aluminum layer (32) may be formed on the silver layer (28) and the cathodoluminescent layer (18). A first end (52) of each of a plurality of spacers is attached to one each of the regions (20), wherein a thermocompression bonding positions the spacer (22) contiguous to the ductile metal layer (28). The second display plate (24), e.g., cathode, is attached to a second end of each of the plurality of spacers (22).

19 Claims, 3 Drawing Sheets

METHOD FOR ATTACHING SPACERS IN AN EMISSION DISPLAY

FIELD OF THE INVENTION

The present invention generally relates to a method for providing spacers in a flat panel display, and more particularly to a method for bonding spacers to an anode and/or cathode of a flat panel display.

BACKGROUND OF THE INVENTION

Several types of spacers for flat panel displays, such as field emission displays, are known in the art. A field emission display includes an envelope structure having an evacuated interspace region between two display plates. Electrons travel across the interspace from a cathode plate (also known as a cathode or a back plate), upon which electron emitting structures, such as Spindt tip or carbon nanotubes, are fabricated, on an anode plate (also known as an anode or face plate), which includes deposits of light emitting materials, or "phosphors". Typically, the pressure within the evacuated interspace region between the cathode and anode is on the order of $10^{-6}$ Torr.

The cathode and anode plates are thin in order to provide low display weight. If the display area is small, such as in a 1 inch diagonal display, and a typical sheet of glass having a thickness of 0.04 inch is utilized for the plates, the display will not collapse or bow significantly. However, if a larger display area is desired, the thin plates are not sufficient to withstand the pressure differential in order to prevent collapse of bowing upon evacuation of the interspace region. For example, a screen having a 30 inch diagonal will have several tons of atmospheric pressure exerted upon it. As a result of this tremendous pressure, spacers play an essential role in large area, light weight displays. Spacers are structures placed between the anode and cathode plates for keeping them a constant distance apart. The spacers, in conjunction with the thin, light weight plates, counteract the atmospheric pressure, allowing the display area to be increased with little or no increase in plate thickness.

Several schemes have been proposed for providing spacers. Some of these schemes include the affixing of spacer (structural members) to the inner surface of one of the display plates. In one such prior art scheme, glass rods are affixed to one of the display plates by applying devitrifying solder glass frit to one end of the rod or post and bonding the frit to the inner surface of one of the display plates. This method includes problems such as bond brittleness, particulate contamination, smearing onto pixels, non-uniformity of the spacer height of the fritted spacer due to initial height variations in the original spacer and non-perpendicularity due to displacement due to cooling of the frit. Other proposed schemes for bonding spacers onto the display plate include the use of organic glue. However, organic glues are burned off before the package is sealed and differential pressure applied, thereby predisposing the spacers to being loosened or misplaced within the envelope of the display.

Another known method uses thermocompression bonding to smash one layer of metal into another layer of metal. The bond that is created is strong enough to permit handling and sealing of the device components. An anode electrode is coated with a patterned chrome oxide black matrix. A one micrometer thick aluminum layer is deposited and patterned on the chrome oxide layer to provide the bonding surface. Without this layer, the spacers do not bond. Before bonding, another aluminum layer, approximately 70 nanometers thick, is deposited over the first aluminum layer and the phosphor.

This layer lies between the thick aluminum bonding surface and the ball-bumps on the spacer; however, since it is thin and perforated, it does not substantially alter the bonding requirements. These films mentioned above are deposited by vacuum deposition techniques, and the thick aluminum layer must be processed photolithography and etch tools.

The known art mentioned above was based on a CRT-like process for making the anodes. Recently, it has become apparent that the fabrication of the anodes can be done more cheaply for large area displays using plasma-display technologies, wherein a black matrix is deposited with screen printing, just like the phosphors. Screen printing eliminates the need to pattern thin films such as Chromium oxide and aluminum, and therefore eliminates the need for capital equipment and processes for vacuum deposition, photoresist coating, photoresist developing, and etching.

However, the spacers do not bond to the black surround screen-printed materials, such as Ruthenium oxide, and other known fabrication alternatives are expensive and not industry process compliant.

Accordingly, it is desirable to provide a spacer bonding technology that works with less expensive thick film techniques currently being applied in the plasma display industry. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A method is provided for bonding spacers to an anode and/or cathode of a flat panel display. The method comprises forming a black matrix layer between a ductile metal layer and a first display plate, the black matrix layer and the ductile metal layer defining a plurality of regions surrounding a plurality of pixels. A cathodoluminescent material is formed within each of the pixels. An aluminum layer may be formed on the ductile metal layer and the cathodoluminescent layer. A first end of each of a plurality of spacers is attached to one each of the regions, wherein a thermocompression bonding process causes the spacers to contact the ductile metal layer. The second display plate, e.g., cathode, is attached to a second end of each of the plurality of spacers.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Figure 1:
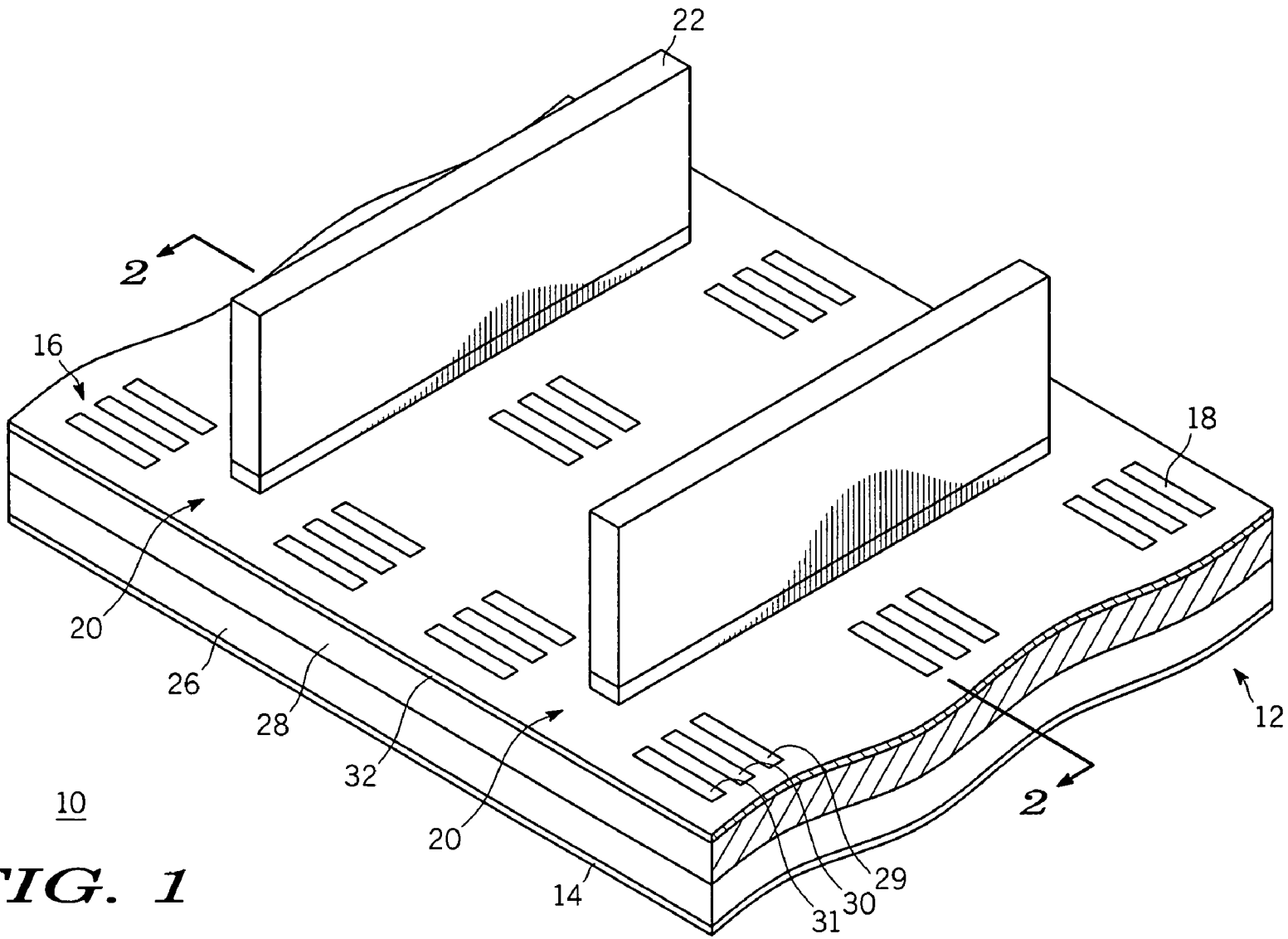
FIG. 1 is an isometric view of an anode of a flat panel display realized by performing various steps of the exemplary embodiment of the present invention.
Figure 2:
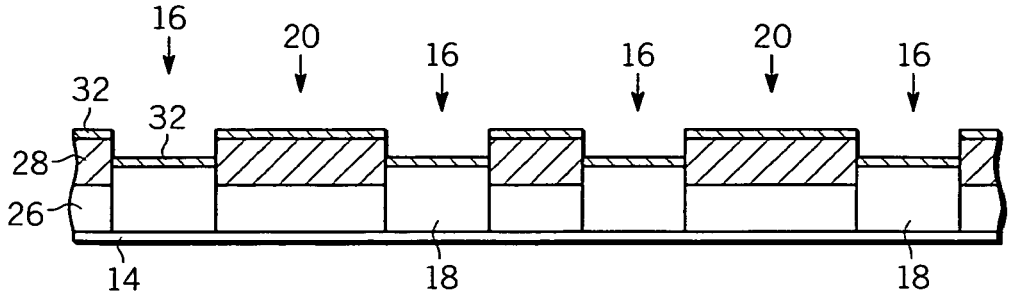
FIG. 2 is a partial cross section without spacers taken along lines 1-1 of FIG. 1.

Referring to FIG. 1 of a partial cutaway isometric view, and to FIG. 2 of a partial cross sectional view taken through one of the pixels 14 from line 1-1, a display 10 shows a first display plate 12, e.g., an anode, for a field emission display that includes a transparent plate 14, which is typically made of glass. A plurality of pixels 16 arranged typically in rows and columns across the anode 12 include deposits of a light emitting material 18, such as a cathodoluminescent material, or phosphor. A plurality of regions 20 exist between the rows and/or columns for making physical contact with spacers 22 so that a predetermined spacing can be maintained between the anode 12 and a second display plate 24 (FIG. 3), e.g., a cathode, without interfering with the light emitting function of the display 10 and thereby defining an evacuation area 25. The spacers 22 comprise a rigid material, e.g., a ceramic material, and are able to withstand intense pressure exerted by the anode and cathodes.

Referring more specifically to FIG. 2, a black surround layer (black matrix) 26, for example ruthenium oxide, is formed on the transparent plate 14. The black surround layer 26 may comprise a thickness in the range of 1-20 μm, and more preferably is 5 μm. A ductile metal layer 28, preferably formed of silver, is applied on the black matrix 26 and adheres thereto. In the preferred embodiment, these layers are deposited with thick film techniques such as screen printing, electrophoretic deposition, or electroplating rather than thin film vacuum deposition techniques. The ductile metal layer 28 must have special properties to be effective. First, it must be chemically and mechanically compatible with the black matrix layer 26. The ductility may be derived from the intrinsic properties of the metal, but it may also result from the microstructure and density of the particles of metal that make up the layer. The ductile metal must promote a strong bond with the materials on the spacer. In addition, the thermal expansion coefficients of the layers and the transparent plate 14 must be compatible such that post-processing at temperatures above 500° C. does not induce stress that results in adhesion failure of the layers. Finding a compatible black matrix-ductile metal system is not simply a matter of picking the correct material. Preserving the adhesion through temperature cycles requires the right materials and the right microstructure of the materials, and the correct processing recipes. Film density, ramp rate, organic binder content, are examples of important parameters. In the preferred embodiment, the ductile metal layer 28 would be deposited by screen-printing because the overall manufacturing cost is critically important. Screen printing requires that the organics in the paste be burned out at high temperatures in an oxidizing atmosphere. The ductile metal must survive this processing. In the preferred embodiment, silver is used as the ductile metal layer 28 because it satisfies the above requirements, and it is available as a low cost screen-printable paste. As indicated above, successful implementation of silver as the ductile metal layer requires that the processing of the silver particles in the paste results in the correct microstructure for ductility and adhesive compatibility with the black matrix layer. The layer 28 may comprise a thickness in the range of 0.1-5 μm, and more preferably is 3 μm. These two layers may be formed across the transparent plate 14 and then screen printed to form the regions 20. For anodes built with the Fodel (photodefinable screen print paste) technology, the silver fodel and the black matrix can be deposited in sequential steps and then exposed with the same photomask. The light emitting material 18 is placed in the pixels 16 by screen printing.

The phosphor-coated display anode 12 described above presents the light emitting material to the direct impact of electrons. This configuration is desirable for displays which use a low anode voltage (<4 kilovolts). High voltage display designs benefit from providing a thin aluminum layer over the light emitting material. A thin layer 32 of aluminum is formed on the silver layer 28 and the light-emitting layer 18 by physical vapor deposition techniques such as evaporation or sputtering. The aluminum layer 32 acts as a reflector and directs all the light generated through the faceplate to the viewer. Without this reflection, half of the light goes towards the electron emitters (not shown). Effectively, the light output from the display anode 12 (faceplate) doubles with the use of the aluminum layer. However, the aluminum layer acts to absorb the energy of the electrons, thereby reducing the light emitted from the faceplate. When using a very thin aluminum layer, nominally 50 nanometers thick, the benefits of reflection outweigh the detriments of energy absorption mentioned above in the range of 4000 volts. Further improvements to the light output can be made by forming the aluminum layer into a reflector dish behind each phosphor. This is a standard practice in cathode ray tube manufacture. In order to achieve a more efficient aluminum shape, standard practice is to deposit a smooth organic material on top of the light emitting layer and black matrix region to form a raised template. Aluminum is then evaporated over the organic layer. The organic layer is burned out at high temperature leaving a tented aluminum layer off the surface of the light emitting material. In order to remove the organic layer via combustion, materials are placed in the organic layer which punch micron-sized holes in the aluminum layer, allowing vapors to escape. The end result is an aluminum layer 32 which is very thin and perforated. The aluminum layer 32 may comprise a thickness in the range of 10-1000 nm, and more preferably is 50 nm.

Figure 3:
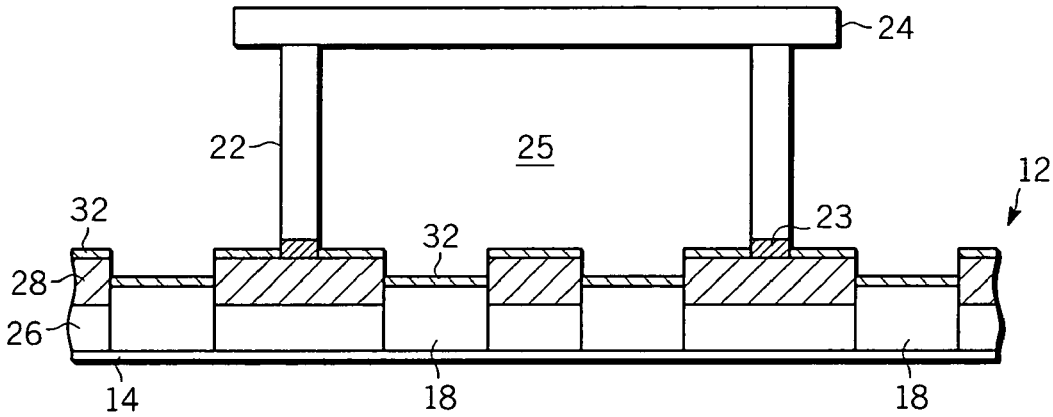
FIG. 3 is the partial cross section of FIG. 2 including the spacers and a cathode.

The spacers 22 are placed on the regions 20 by one of a number of standard metal to metal bonding techniques, such as thermocompression bonding, thermosonics bonding, ultrasonic bonding and the like. In this particular embodiment, a thermocompression method is used to contact the silver layer 28, as shown in FIG. 3. Mechanical deformation aids the bonding. In the case where a thin aluminum layer 32 is applied to the top of the ductile metal layer 28, the aluminum is already perforated and bonding can occur through the pores. In addition, the bonding techniques such as thermocompression bonding, thermosonics bonding, and ultrasonic bonding create more than enough mechanical deformation to break apart the thin aluminum layer, thereby bonding between the spacer 22 and the ductile metal layer 28. Some of the aluminum layer 32 may remain between the spacer 22 and the ductile metal layer 28. In effect, the aluminum layer 32 is so thin and perforated, and so easily broken apart that it does not participate in the bonding process. The presence or absence of this aluminum layer 32 makes a no meaningful difference to the spacer bonding process. The bonding is performed at elevated temperatures from 50-500 degrees, preferably at 250 degrees Celsius. A bonding force between 100 to 10000 grams is then applied to the spacer to bond the Au layer and the Al coated silver layer. In this particular embodiment, a load of 2000 grams is used.

Compared to other methods that employ glass frit, organic glue or laser attach, this method provides a simple but effective way of bonding spacers. Metal to metal bonding is very clean with no contamination issues from organic vapors; metal layers are pliable and thus eliminating the generation of particulates. Metal to metal bonding provides compliance and increases the dimensional tolerance allowed for the spacers. Most importantly, since every step is done using screen printing technique, the manufacture process is extremely simple and inexpensive.

Electron emitting structures (not shown), such as Spindt tips or carbon nanotubes, are positioned on the cathode 24 for directing electrons at and illuminating the light emitting material 18 positioned on the anode 28 as is well known in the industry. Each pixel of the plurality of pixels 16 is divided into three subpixels 29, 30, 31. Each subpixel is formed by a phosphor corresponding to a different one of the three primary colors, for example, red, green, and blue. Correspondingly, the electron emission sites on the cathode are grouped into pixels and subpixels, where each emitter subpixel is aligned with a red, green, or blue subpixel 29, 30, 31 on the anode 12. By individually activating each subpixel 29, 30, 31, the resulting color can be varied anywhere within the color gamut triangle. The color gamut triangle is a standardized triangular-shaped chart used in the color display industry. The color gamut triangle is defined by each individual phosphor's color coordinates, and shows the color obtained by activating each primary color to a given output intensity.

Figure 5:
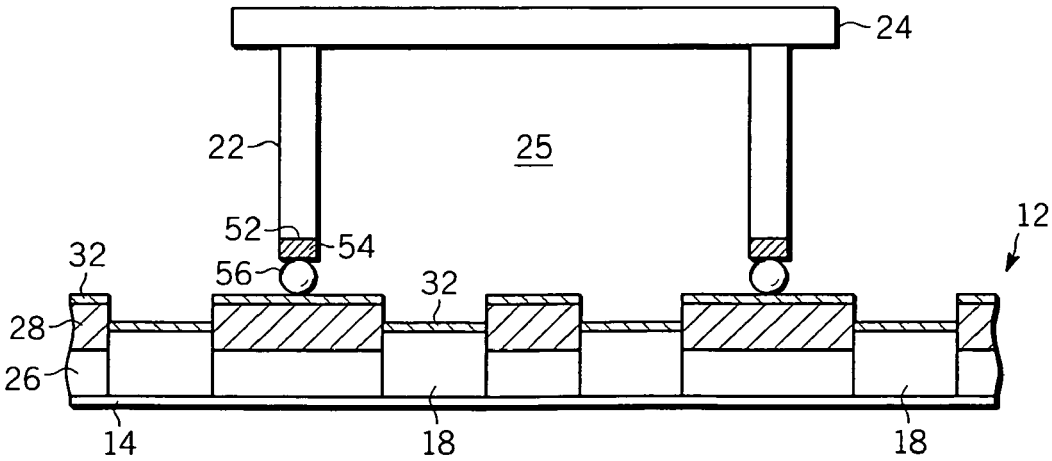
FIG. 5 is a partial cross section taken along lines 4-4 of FIG. 4 and including a cathode.
Figure 4:
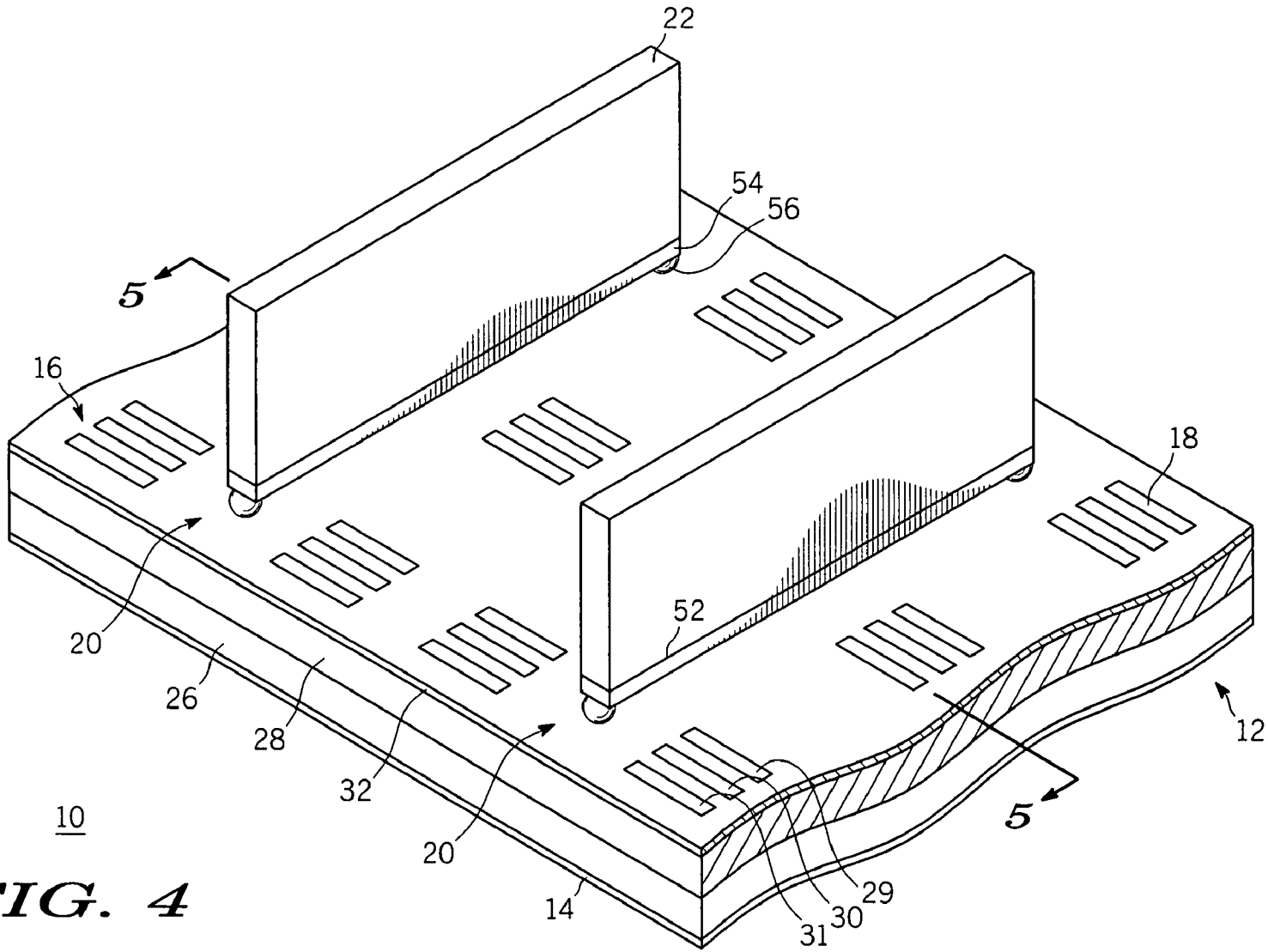
FIG. 4 is an isometric view of an anode of a flat panel display realized by performing various steps of another exemplary embodiment of the present invention.

A second exemplary embodiment, shown in FIGS. 4 and 5, comprises the anode 12 fabricated in a like manner to that described in the first exemplary embodiment. However, as disclosed in U.S. Pat. No. 5,811,927, the spacers 22 have an edge 52 coated by any of a number of standard deposition techniques, including screen printing. In this embodiment, a bonding layer 54 is made from gold and is 0.2-10.0 micrometers thick and preferably 5.0 micrometers thick. In other embodiments, other metals, such as silver, are deposited on edges 52 with a screen printing technique and thermally bonded. The thickness of the bonding layer 54 depends on the type of metal employed and the type of metal to which it is subsequently bonded. The metal comprising bonding layer 54 must be suitable for forming a metal-to-metal bond by one of a number of standard methods, such as thermocompression bonding, ultrasonic bonding, and thermosonic bonding.

Metallic compliant members 56 are affixed to the bonding layer 54 via metal-to-metal bonds. Metallic compliant members 56 include a metal having a low yield strength, thereby providing a material having suitable compliance to provide uniform spacing between the display plates of the flat panel display. Metallic compliant members 56 also have a geometry which facilitates the metal-to-metal bonding. While the geometry of metallic compliant members 56 affects the amount of force required to create metallic bonds formed with them, it also affects the yield rate of metallic compliant members 56, a favorable value for which will provide the desired compliance of metallic compliant members 56. In this particular embodiment, metallic compliant members 56 include essentially spherical balls. These balls typically have a diameter between 50 micrometers and 150 micrometers. The use of essentially round wire or spherical balls is beneficial since these shapes result in a bonding force which is low and can prevent breakage of spacers 22 during bonding steps, and the yield force, or force sufficient to cause plastic deformation of metallic compliant members 56 to accommodate the height tolerances typically encountered in spacers 22. In this particular embodiment, metallic compliant members 56 are made from a gold alloy which included 1-2% palladium. In other embodiments, metallic compliant members 56 are made from essentially pure gold.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims.

The invention claimed is:

1. A method for affixing a plurality of spacers within a flat panel display having first and second display plates, comprising:

forming a black matrix layer on the first display plate;

forming a ductile metal layer comprising silver on the black matrix layer, the black matrix layer and the ductile metal layer defining a plurality of regions surrounding a plurality of pixels;

forming a cathodoluminescent material within each of the pixels;

attaching a first end of each of a plurality of spacers to one each of the regions to contact the ductile metal layer; and attaching the second display plate to a second end of each of the plurality of spacers.

2. The method of claim 1 wherein forming a ductile metal layer comprises forming a silver layer having a thickness of approximately 3 microns.

3. The method of claim 1 further comprising forming an aluminum layer on the ductile metal layer and the cathodoluminescent layer.

4. The method of claim 3 wherein forming the aluminum layer comprises forming an aluminum layer having a thickness of approximately 0.05 microns.

5. The method of claim 3 wherein the attaching step comprises applying sufficient mechanical deformation to bond the spacer to the ductile metal layer through the aluminum layer.

6. The method of claim 1 wherein the attaching a first end of each of a plurality of spacers comprises using thermocompression bonding.

7. The method of claim 1 wherein defining a plurality of regions comprises screen printing the black matrix layer and the ductile metal layer.

8. The method of claim 1 further comprising forming a bonding layer between the ductile metal layer and each of the spacers.

9. The method of claim 8 wherein the bonding layer is formed prior to the attaching a first end of each of a plurality of spacers.

10. The method of claim 9 further comprising forming a metallic compliant member between the bonding layer and the ductile metal layer.

11. The method of claim 10 further comprising forming a metallic compliant member of silver.

12. The method of claim 10 further comprising forming a metallic compliant member as a gold ball bump.

13. The method of claim 10 further comprising forming a metallic compliant member by screen printing.

14. The method of claim 10 further comprising forming a metallic compliant member of gold.

15. The method of claim 1 wherein the forming a black matrix layer and the ductile metal comprises forming as photo-definable materials masked in the same masking step.

16. A method for affixing a plurality of spacers within a flat panel display having first and second display plates, comprising:

forming a black matrix layer on the first display plate;

forming a silver layer on the black matrix layer;

screen printing the black matrix layer and the silver layer to define a plurality of regions surrounding a plurality of pixels;

forming a cathodoluminescent material within each of the pixels;

forming an aluminum layer on the silver layer and the cathodoluminescent layer;

forming a metallic bonding layer on a first end of each of the plurality of spacers;

placing the first end of each of a plurality of spacers to one each of the regions;

applying sufficient mechanical deformation to bond the spacer to the ductile metal layer; and attaching the second display plate to a second end of each of the plurality of spacers.

17. The method of claim 16 further comprising forming a metallic compliant member between the metallic bonding layer and the silver layer.

18. The method of claim 17 wherein comprising forming a metallic compliant member comprises forming a gold bump.

19. The method of claim 16 wherein the forming a black matrix layer and the ductile metal comprises forming as photo-definable materials masked in the same masking step.

* * * * *